US005472148A

United States Patent [19]

Schaeffer

[11] Patent Number: 5,472,148

[45] Date of Patent: Dec. 5, 1995

[54] GRINDING MILL, LINING AND ASSOCIATED METHOD OF MANUFACTURE

[75] Inventor: Leon E. Schaeffer, Sandy, Utah

[73] Assignee: Envirotech Pumpsystems, Inc., Salt Lake City, Utah

[21] Appl. No.: 159,769

[22] Filed: Nov. 30, 1993

Related U.S. Application Data

[62] Division of Ser. No. 819,384, Jan. 10, 1992, abandoned.

[51] Int. Cl.[6] ..... B02C 17/22

[52] U.S. Cl. ..... 241/183; 241/DIG. 30; 241/299

[58] Field of Search ..... 241/183, 182, 241/DIG. 30, 299, 176

[56] References Cited

U.S. PATENT DOCUMENTS

| | | | |
|---|---|---|---|
| 798,413 | 8/1905 | Howard | 428/133 |
| 887,575 | 5/1908 | Barry | 241/182 |
| 1,068,289 | 7/1913 | White et al. | 241/183 |
| 1,457,487 | 6/1923 | Bartley . | |
| 1,468,893 | 9/1923 | Wolever . | |
| 1,470,597 | 10/1923 | Denny et al. . | |
| 1,539,237 | 5/1925 | Borcherdt | 241/183 |
| 1,925,271 | 9/1933 | Miller | 428/465 |
| 2,128,468 | 8/1938 | Miller | 241/183 |
| 2,998,201 | 8/1961 | Ratkowski . | |
| 3,353,758 | 11/1967 | Whaley et al. . | |
| 3,607,606 | 9/1971 | Benings . | |
| 3,637,147 | 1/1972 | Naredi . | |
| 3,880,365 | 4/1975 | Eigner . | |
| 3,932,249 | 1/1976 | Jury et al. | 72/260 |
| 3,934,828 | 1/1976 | Persson | 241/DIG. 30 |
| 3,942,239 | 3/1976 | Johansson . | |
| 4,032,075 | 6/1977 | Tyer, Sr. . | |
| 4,194,710 | 3/1980 | Ebner . | |
| 4,243,182 | 1/1981 | Dugger, Jr. . | |
| 4,289,279 | 9/1981 | Brandt | 241/183 |

(List continued on next page.)

FOREIGN PATENT DOCUMENTS

| | | | |
|---|---|---|---|
| 5816080 | 1/1981 | Australia . | |
| 3781789 | 1/1990 | Australia . | |
| 1000102 | 2/1983 | U.S.S.R. | 241/182 |
| 1304872 | 4/1987 | U.S.S.R. . | |
| WO8101253 | 5/1981 | WIPO . | |

OTHER PUBLICATIONS

Lovering et al. "Grinding experience at Afton," in *Minerals and Metallurgical Processing*. May 1986.

Roland Svensson, "New Lining Concepts for Primary Grinding Mills," Trellex AB, Trelleborg, Sweden, published prior to Jan. 10, 1992.

Klas-Goran Eriksson et al., "Mill Linings for Autogenous and Semi-Autogenous Grinding Mills," Skega AB, Ersmark, Sweden, published prior to Jan. 10, 1992.

*Primary Examiner*—Richard K. Seidel
*Assistant Examiner*—Allan M. Schrock
*Attorney, Agent, or Firm*—R. Neil Sudol; Henry D. Coleman

[57] ABSTRACT

In a grinding mill, a polymeric filler material is molded into the rectangular or prismatic recesses in a metallic or ceramic lining. In a grinding mill where longitudinally extending elongate ribs of the lining have two different radial thicknesses or heights, with relatively narrow bars and relatively thick bars alternating with one another, the filler material is initially cast to have a cylindrical or undulating inner surface. Where the surface is cylindrical, the filler material is worn away during use of the grinding mill and gradually conforms to the alternating narrow and thick bars to assume an undulating inner surface. Supplemental lifter bars may be embedded in the grid and rubber filler material during the casting process. Where the lining is assembled from elongate wedge-shaped metallic or ceramic bas and spacers, the bars and spacers are provided in modular forms with the spacers as wing-like extensions on the bars. Ceramic or other hard particles are embedded in the filler material. The filler material may extend into the circumferential spacers to provide a cushioning effect.

5 Claims, 5 Drawing Sheets

U.S. PATENT DOCUMENTS 4,329,767 5/1982 Niitti ..... 241/182
4,394,982 7/1983 Wilson .
4,402,465 9/1983 Persson et al. .
4,424,938 1/1984 Day ..... 241/DIG. 30
4,583,575 4/1986 Lundmark .
4,609,158 9/1986 Wilson ..... 241/182
4,717,083 1/1988 Quast et al. .
4,848,681 7/1989 Eriksson et al. .
4,936,519 6/1990 Pichlmaier et al. .

GRINDING MILL, LINING AND ASSOCIATED METHOD OF MANUFACTURE

This application is a division of application Ser. No. 819,384, filed Jan. 10,1992 now abandoned.

BACKGROUND OF THE INVENTION

This invention relates to grinding mill. More particularly, this invention relates to a lining for a grinding mill. The present invention also relates to an associated method for manufacturing a grinding mill lining.

A grinding mill generally comprises a cylindrical drum which is mounted for rotation about its longitudinal axis. A grinding medium such as pebbles, steel balls, or ceramic balls is fed to the drum, together with the material to be pulverized. During rotation of the drum about its longitudinal axis, the grinding medium and the material to be ground are carried up the side of the drum, to subsequently fall to the bottom of the drum. The grinding occurs principally by attrition and impact within the grinding mill charge.

In order to protect the drum from the grinding action and to thereby lengthen the life of the grinding mill, the drum is provided with a metal or a rubber lining. A lining for the cylindrical inner surface of a grinding mill drum is either an assembly of modular lining sections or an assembly of elongate wedge-shaped ribs forcibly held in place with circumferentially extending spacers. The longitudinally extending ribs and/or supplementary lifter bars facilitate the carrying of the grinding medium and subject material with the drum during rotation thereof, thereby creating the grinding action.

Rubber linings are especially advantageous owing to their relatively light weight. Rubber linings are safer and faster to exchange. In addition, rubber linings result in less load on the bearings and less stress on the mill heads. Other advantages of rubber linings are a reduced noise level and reduced operating costs.

Until now, rubber linings have been used exclusively in slow or regular speed grinding mills, with angular velocities up to approximately 80% of the critical speed (the rotational speed at which the drum contents adhere to the liner by virtue of centrifugal forces). In addition, rubber linings have not been economical with large diameter grinding balls. Accordingly, only metal linings have been used at high rotational speeds and/or with large diameter grinding media.

The ribs and spacers of conventional grinding mill linings generally form recesses along the inner surface of the grinding mill. In using such a conventional grinding mill to pulverize gold ore, gold particles are frequently trapped in the recesses in the mill lining. This trapping of the gold material, known as "gold hold" can result in substantial loss of gold material or increased costs in retrieving the gold material from the lining. The same is true for other precious metals.

OBJECTS OF THE INVENTION

An object of the present invention is to provide a grinding mill lining for high speed use which is lighter than conventional high speed linings of solid metal.

A further object of the present invention is to provide a lining for a high speed grinding mill which results in a reduced noise level and/or reduced operating costs.

An additional object of the present invention is to provide a lining for a grinding mill which can be used for any grinding speed and for grinding media of any size.

Another object of the present invention is to provide such a lining which is inexpensive and easy to produce.

Yet another object of the present invention is to provide a grinding mill lining which reduces, if not eliminates, the incidence of gold hold (and trapping of other precious metals).

An additional object of the present invention is to provide a method for manufacturing such a grinding mill lining.

SUMMARY OF THE INVENTION

A grinding mill assembly in accordance with the present invention comprises a cylindrical housing or drum having a longitudinally extending axis and a lining inside the housing. The lining includes a plurality of elongate ribs which are made of a metallic or ceramic material and which extend parallel to the housing axis along an inner surface of the housing. The lining further comprises spacer elements for spacing the ribs from each other circumferentially about the housing. The spacer elements and the ribs define a plurality of recesses and each of the recesses are at least partially filled with a rubber or polymeric filler material.

Pursuant to a feature of the present invention, the ribs include first elongate ribs having a first height and second elongate ribs having a second height larger than the first height. Preferably, the first elongate ribs and the second elongate ribs are disposed in alternation about the housing. More preferably, the first elongate ribs and the second elongate ribs alternate in pairs about the housing.

Pursuant to another feature of the present invention, the filler material has a varying thickness so that an inner surface of the lining has an undulating profile.

The grinding mill assembly may further comprise a plurality of lifter bars extending parallel to the ribs, the lifter bars being embedded in the grid and filler material. Preferably, the lifter bars are embedded in the grid and filler material in juxtaposition to respective ones of the first elongate ribs.

In a specific embodiment of the present invention, the lining comprises a plurality of modular cylindrical sections each including a plurality of the ribs integrally connected to one another via the spacer elements.

In another specific embodiment of the present invention, the spacer elements include spacer portions made of the metallic or ceramic material interleaved with portions made of the rubber or polymeric filler material.

In yet another specific embodiment of the invention, the ribs are preferably wedge-shaped in cross-section, while the spacer elements comprise a plurality of separate spacer elements extending between adjacent ones of the ribs, the ribs and the spacer elements being wedged together to maintain the form of the lining.

Pursuant to a further feature of the present invention, particles of a hard material such as ceramic may be embedded in the filler material.

In yet another specific embodiment of the present invention, the ribs each take the form of a channel, the filler material being disposed in the channel.

A lining module for a grinding mill comprises, in accordance with the present invention, a grid made of a material selected from a metal alloy or a ceramic. The grid includes a plurality of essentially straight elongate ribs extending parallel to each other along a cylindrical arc and a plurality of spacer members each extending in a circumferential direction along the cylindrical arc between respective ones of the ribs to define with the ribs a plurality of recesses. The recesses are at least partially filled with a rubber or polymeric filler material.

As described hereinabove with reference to a complete lining, the ribs of a lining module or modular lining section in accordance with the present invention may be of different radial dimensions or heights, with relatively narrow or low bars and relatively thick or high bars alternating with one another along the lining section. Preferably, the low bars and the high bars alternate in pairs about the cylindrical arc. As further described above, the filler material may have a varying thickness so that a radially inner surface of the lining module has an undulating profile In this geometry of the inner surface of the modular lining section the troughs of the undulations are in regions of the relatively low bars or ribs, while the crests of the undulations are in regions of the relatively high bars.

In one method of manufacturing such a modular lining section, it is simpler to mold the filler material so that it has a cylindrical inner surface and completely covers the low bars. During a grinding process, the filler material is gradually and selectively worn away to approach the undulating configuration.

A modular lining section in accordance with the present invention may be provided with a plurality of lifter bars extending parallel to the ribs, the lifter bars being embedded in the grid and filler material. Preferably, the lifter bars are embedded in the grid and filler material in juxtaposition to the relatively low bars.

As further discussed above with reference to a complete lining, the filler material in a modular lining section in accordance with the present invention advantageously incorporates particles of a hard material (e.g., ceramic). The hard particles are embedded in the filler material.

A method for manufacturing a lining for a grinding mill comprises, in accordance with the present invention, the step of providing a grid in the form of a cylindrical section, the grid being made of a material selected from a metal alloy or a ceramic, the grid including a plurality of elongate ribs extending parallel to each other along a cylindrical arc and a plurality of arcuate spacer members extending in a circumferential direction along the cylindrical arc between respective ones of the ribs to define with the ribs a plurality of recesses. In a subsequent step, a rubber or polymeric filler material is deposited and molded (cast) in the recesses of the grid.

Where the ribs of a lining or modular lining section in accordance with the present invention are of different radial dimensions or heights, with relatively narrow or low bars and relatively thick or high bars alternating with one another along the lining section, the step of molding includes the step of molding the rubber or polymeric filler material so that it has a cylindrical inner surface and completely covers the first elongate ribs. Although the molding could be implemented so that the inner surface of the filler material has an undulating or wave-like profile, it is considered more cost effective to manufacture the lining or lining sections with a cylindrical inner surface and to have the undulating surface generated by a wearing action during use of a grinding mill incorporating the lining or lining sections.

Pursuant to another feature of the present invention, the method of manufacturing a grinding mill lining or lining section comprises the additional step of embedding a plurality of lifter bars in the grid and filler material so that the lifter bars extend parallel to the ribs. Where the ribs are of different radial dimensions, the lifter bars are embedded in the grid and filler material in juxtaposition to the low bars, and more specifically, radially inwardly thereof.

Pursuant to yet another feature of the present invention, the method of manufacturing a grinding mill lining or lining section also comprises the steps of sand blasting the grid and then depositing a bonding material on the grid prior to the step of molding. Specifically, the bonding material may be sprayed onto the grid.

In accordance with another feature of the invention, the method of manufacturing may include the further step of embedding particles of a hard material in the filler material.

A modular lining elements for a grinding mill comprises, in accordance with the present invention, an essentially straight bar and a plurality of first spacer wings integrally connected to the bar and projecting essentially perpendicularly therefrom on a first side of the bar. The first spacer wings are spaced from one another. The modular lining element further comprises a plurality of second spacer wings also integrally connected to the bar. The second spacer wings also project essentially perpendicularly from the bar on a second side thereof substantially opposite the side carrying the first spacer wings. The second spacer bars are also spaced from one another.

A lining element in accordance with the present invention is preferably wedge-shaped in cross-section and the first spacer wings on the one side of the bar are aligned with respective second spacer wings on the opposite side of the bar.

Another method for making a lining for a grinding mill comprises, in accordance with the present invention, the step of providing a plurality of modular lining elements as described above. Accordingly, each such lining element comprises an essentially straight bar and a plurality of first spacer wings integrally connected to the bar and projecting essentially perpendicularly therefrom on a first side of the bar, each lining element further comprising a plurality of second spacer wings also integrally connected to the bar and projecting essentially perpendicularly therefrom on a second side of the bar substantially opposite the first side, the first spacer wings being spaced from one another and the second spacer bars being spaced from one another. In another step, the modular lining elements are disposed parallel to each other along a cylindrical arc. A rubber or polymeric filler material is then deposited in recesses formed between the modular lining elements during the step of disposing. The filler material is cured upon the complete or partial filling of the recesses during the deposition step.

Pursuant to another feature of the present invention, the step of disposing the winged lining elements includes the step of aligning the first spacer wings on a given one of the modular lining elements with the second spacer wings on an adjacent one of modular lining elements to form the recesses so that the recesses are substantially rectangular or square. More particularly, the modular lining elements are spaced from one another so that the first spacer wings on the given one of the modular lining elements are spaced a predetermined distance from the second spacer wings on the adjacent one of modular lining elements. In that case, the step of depositing includes the step of filling in, with the filler material, the spaces between the first spacer wings on the given one of the modular lining elements and the second spacer wings on the adjacent one of modular lining elements.

Yet another method for making a lining for a grinding mill comprises, in accordance with the present invention, the steps of (a) providing a plurality of substantially straight elongate substantially wedge-shaped bars each having a substantially wedge-shaped cross-section and made of a material selected from a metal alloy or a ceramic, (b) further providing a plurality of spacer elements made of a material selected from a metal alloy or a ceramic, (c) disposing the bars parallel to and spaced from each other along a cylindrical arc, (d) disposing the spacer elements between the bars substantially perpendicularly thereto to define a plurality of recesses between the bars, (e) molding a rubber or polymeric filler material in the recesses, and (e) curing the filler material upon completion of the step of molding.

Pursuant to another feature of the present invention, the steps of disposing include the step of spacing the spacer elements and the bars to form gaps so that each of the recesses communicates with at least one other of the recesses prior to the step of molding and so that after the step of molding filler material in each of the recesses is continuous with filler material in at least one other of the recesses.

A grinding mill element in accordance with the present invention takes the form of a lifter bar for use in a grinding mill, the lifter bar including an elongate rubber or polymeric body having a top face and a leading face, a planar metal grid section being embedded in the body at the top face, the leading face, or both. The grid section may define a plurality of recesses filled with the rubber or polymeric material of the body.

A grinding mill lining in accordance with the present invention can be used for any grinding speed and for grinding media of any size and the grinding mill lining is lighter than conventional high speed solid metal linings.

A lining for a high speed grinding mill in accordance with the present invention also results in a reduced noise level and/or reduced operating costs.

Another advantage of a grinding mill lining in accordance with the present invention is that the lining serves to reduce, if not eliminate, gold hold. In addition, such an improved lining is longer lasting and more durable than conventional linings.

Yet another advantage of a grinding mill lining in accordance with the present invention is that the lining facilitates the carrying of ore up the side of the grinding mill drum during grinding operations.

DETAILED DESCRIPTION

Figure 1:
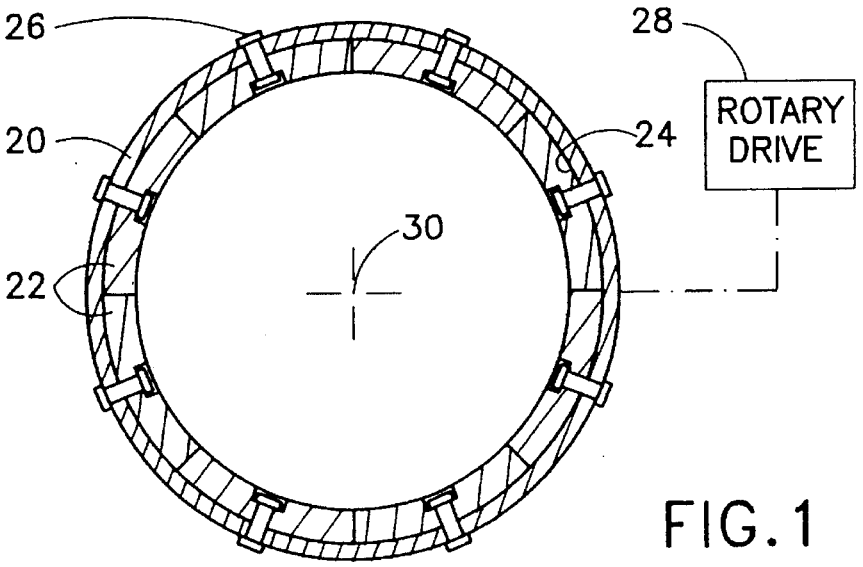
FIG. 1 is a schematic transverse cross-sectional view through a grinding mill drum employing a plurality of modular lining sections in accordance with the present invention.

As illustrated in FIG. 1, a grinding mill comprises a cylindrical drum 20 and a plurality of modular cylindrical lining sections 22. Lining sections 22 are attached to a cylindrical inner surface 24 of drum 20 via bolts 26. A rotary drive 28 is operatively connected to drum 20 for rotating the drum about a longitudinal axis 30.

Figure 2:
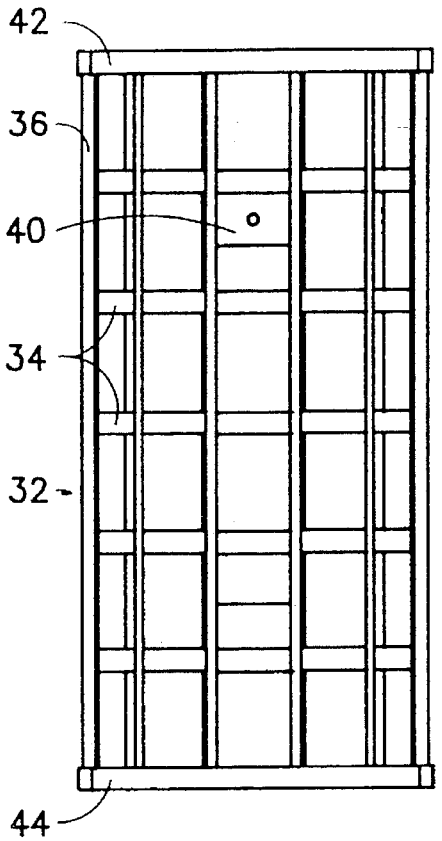
FIG. 2 is a top view of a modular lining section for a grinding mill, showing recesses or openings to be filled with a rubber or polymerc material in accordance with the present invention.

Each modular lining section 22 comprises a grid 32 (FIG. 2) having plurality of elongate ribs 34 which extend parallel to axis 30 along surface 24 of the housing. Grid 32 also comprises a plurality of spacer elements 36 for spacing ribs 34 from each other circumferentially about drum 20. Ribs 34 and spacer elements 36 are made of a metallic material such as a manganese or chrome/molybdenum steel or a ceramic material and define a plurality of rectangular or square recesses or openings Grid 32 also includes anchoring plates 40 for receiving bolts 26 and arcuate end ribs 42 and 44.

Figure 3:
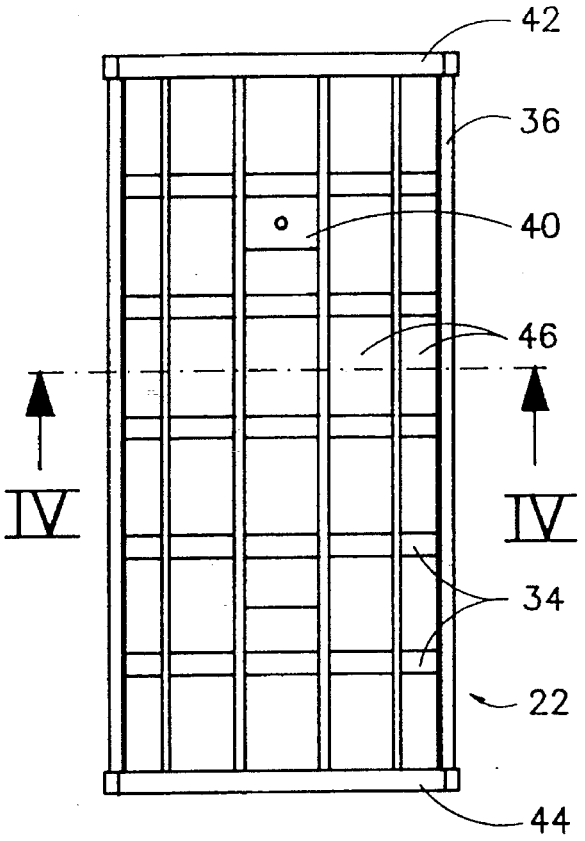
FIG. 3 is top view of the modular lining section of FIG. 2, showing recesses or openings filled with a rubber or polymeric material, in accordance with the present invention.
Figure 4:
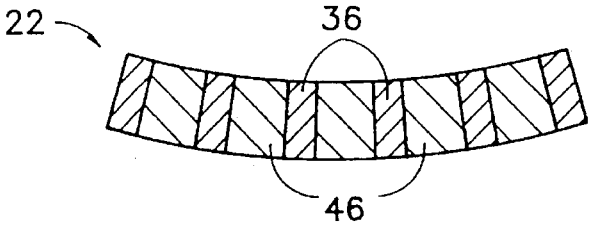
FIG. 4 is a cross-sectional view taken along line IV—IV in FIG. 3.

As shown in FIGS. 3 and 4, each recess 38 of grid 32 is at least partially filled with a rubber (for example, a blend of natural and synthetic rubber) or polymeric filler material 46 such as polyethylene or polyurethane. The filler material is deposited, e.g., molded, into recesses 38 and subsequently cured or hardened.

Figure 5:
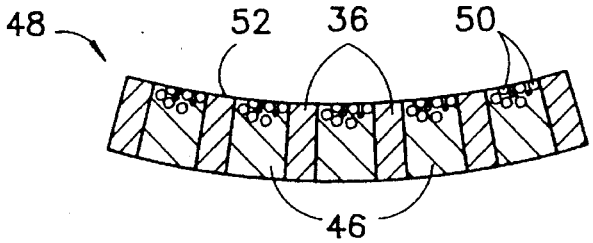
FIG. 5 is a cross-sectional view similar to FIG. 4, showing a modification the modular lining section of FIGS. 3 and 4.

In a modified grinding mill lining section 48 depicted in FIG. 5, particles 50 made of a hard material such as ceramic are embedded in rubber or polymeric filler material 46 during the molding process. Particles 48 are disposed at least along a concave or inner surface 52 of lining section 48 and may be dispersed throughout the filler material 46. Particles 48 may have virtually any shape, including cubic, spherical, cylindrical, polyhedral, or irregular.

Figure 6:
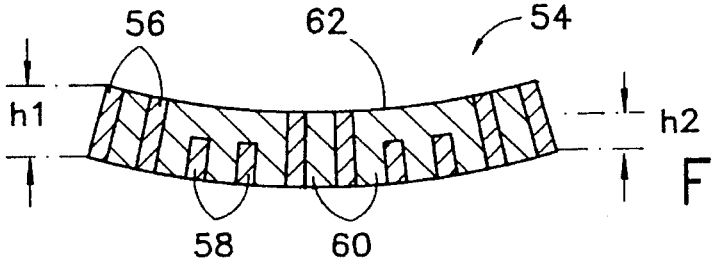
FIG. 6 is a cross-sectional view similar to FIGS. 4 and 5, showing another modification of the modular lining section of FIGS. 3 and 4.

As illustrated in FIG. 6, another cylindrical grinding mill lining section 54 comprises a rectangular grid with a plurality of relatively high longitudinal ribs 56 having a radial thickness or height h1 and a plurality of relatively low longitudinal ribs 58 having a radial thickness or height h2 which is less than height h1. Ribs 56 and 58 alternate in pairs with one another in a circumferential direction about the cylindrical arc of grinding mill lining section 54. The ribs are spaced by spacer elements (not shown), a rubber or polymeric filler material 60 being molded between the ribs 56 and 58 to have a cylindrical inner surface 62.

Figure 7:
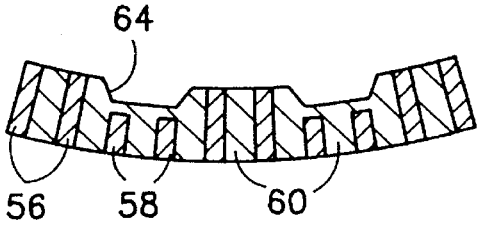
FIG. 7 is a cross-sectional view of the modular lining section of FIG. 6 after the lining section has been used in a grinding process.

FIG. 7 depicts lining section 54 after the lining section has been used in a grinding process. Rubber or polymeric material 60 has been partially worn or ground away in the regions of low ribs 58 to form an undulating inner surface 64 having crests in the regions of high ribs 56 and troughs in the regions of low ribs 58. This configuration of lining section 54 is considered to be particularly efficacious in the carrying of grinding media and ore up the side of the grinding mill drum during a grinding process, while preventing the accumulation of gold or other valuable substance along the lining.

It is to be noted that lining section 54 can alternatively be manufactured to have the undulating inner surface of FIG. 7 as the original form.

Figure 8:
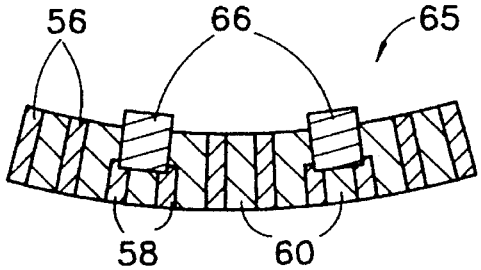
FIG. 8 is a cross-sectional view similar to FIGS. 4–6, showing a further modification of the modular lining section of FIGS. 3 and 4.

FIG. 8 illustrates a cylindrical grinding mill lining section 65 substantially the same as lining section 54, with like structural components having the same reference designations. Lining section 65 is further provided with one or more longitudinally extending lifter bars 66 embedded in filler material 60 and in narrow or low ribs 58.

Figure 9:
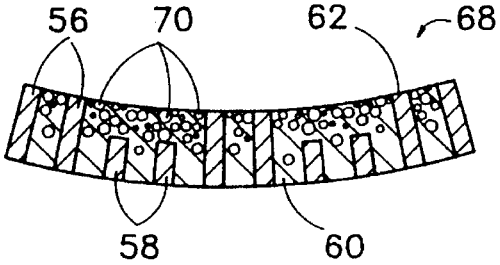
FIG. 9 is cross-sectional view similar to FIG. 6, showing a modification of the modular lining section of that drawing figure.

FIG. 9 shows a cylindrical grinding mill lining section 68 substantially the same as lining section 54, with like structural components having the same reference designations. In lining section 68, the wearing away of rubber or polymeric filler material 60 is impeded by ceramic particles 70 which are embedded in the rubber or polymeric material 60. As discussed hereinabove with reference to FIG. 5, particles 70 are disposed along concave or inner surface 62 of lining section 68 or are, alternatively dispersed uniformly throughout filler material 60. Particles 70 may be cubic, spherical, cylindrical, polyhedral, or irregularly shaped.

Figure 10:
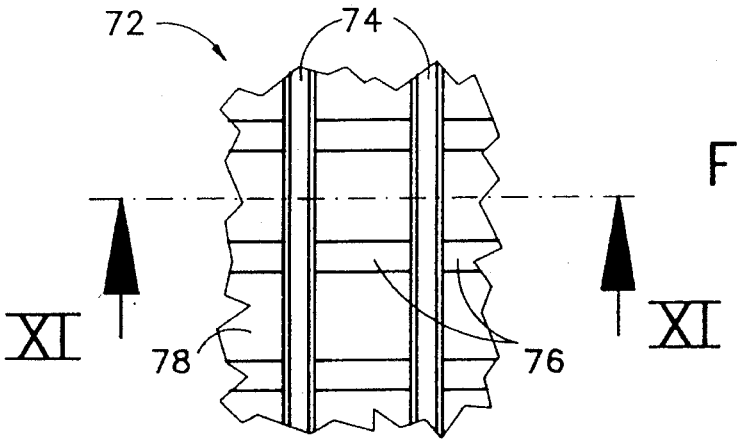
FIG. 10 is a partial top view of another grinding mill lining in accordance with the present invention.
Figure 11:
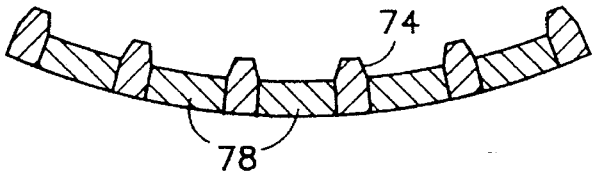
FIG. 11 is a partial cross-sectional view taken along line XI—XI in FIG 10.

As depicted in FIGS. 10 and 11, a grinding mill lining 72 comprises a plurality of longitudinally extending ribs 74 each having a cross-section which is at least partially wedge shaped. Lining 72 is assembled on site from ribs 74 and a plurality of modular, prefabricated metallic or ceramic spacers 76 and a plurality of modular, prefabricated rubber or polymeric spacers 78.

Figure 12:
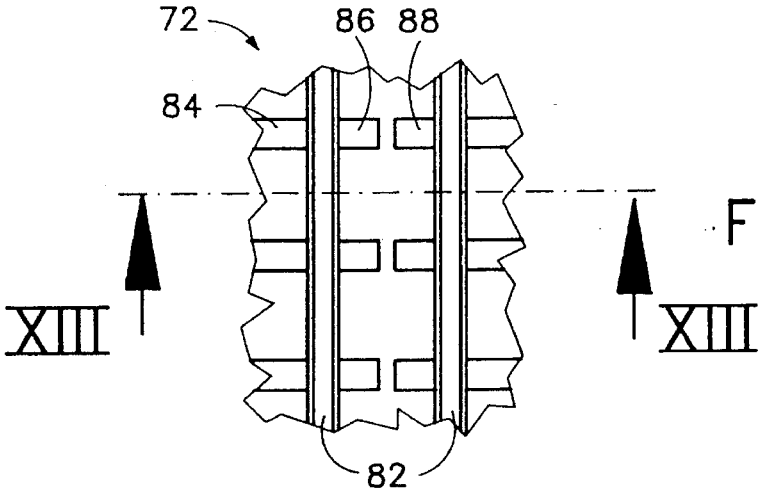
FIG. 12 is a partial top view of yet another grinding mill lining in accordance with the present invention.
Figure 13:
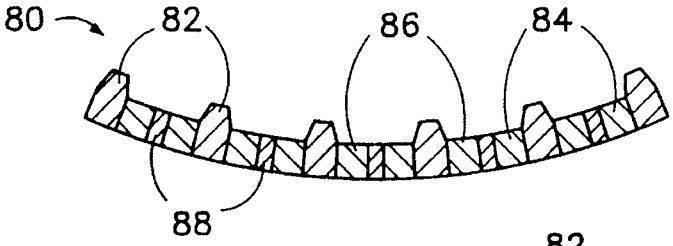
FIG. 13 is partial cross-sectional view taken along line XIII—XIII in FIG. 12.
Figure 14:
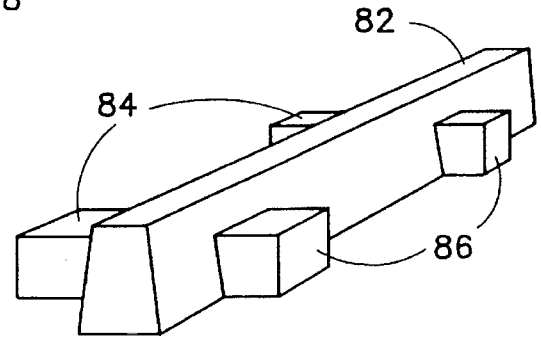
FIG. 14 is a partial perspective view of a modular lining element for use in fabricating the lining of FIGS. 12 and 13.

As illustrated in FIGS. 12–14, another grinding mill lining 80 comprises a plurality of longitudinally extending modular ribs or bars 82 each provided with a plurality of integral spacer wings 84 and 86 on opposite sides of the respective bar. The spacer wings 84 or 86 on the same side of a given bar 82 are longitudinally spaced from one another and project essentially perpendicularly from the bar. In addition, each spacer wing 84 on one side of a given bar 82 is aligned with and opposite a respective wing 86 on the opposite side of the bar.

In manufacturing lining 80, two or more bars 82 are placed along a cylindrical surface (not shown) in spaced relation to one another. End bars (e.g., 42 and 44 in FIGS. 2 and 3) are placed at the ends of bars 82, in contact therewith, to define at least one recess (not separately designated) into which wings 84 of one bar and wings 86 of the other bar project. Into the recess is deposited or molded a rubber or polymeric material 88 which is subsequently hardened.

Figure 15:
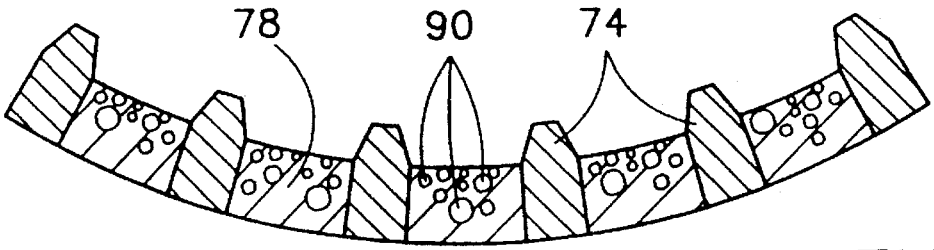
FIG. 15 is partial cross-sectional view similar to FIG. 11, showing a modification of the grinding mill lining of FIGS. 10 and 11.

As shown in FIG. 15, rubber or polymeric spacers 78 may contain particles 90 of a wear resistant material.

Figure 16:
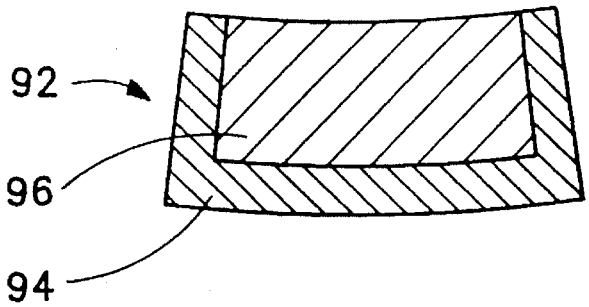
FIG. 16 an view of a channel element for a grinding mill in accordance with the present invention.
Figure 17:
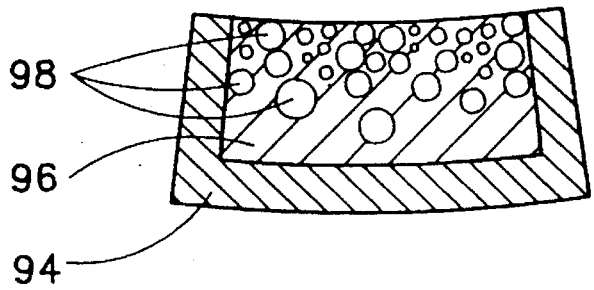
FIG. 17 is an and view of another channel element similar to the element of FIG. 14, showing a modification of that grinding mill element.

FIG. 16 depicts an elongate modular channel element 92 for forming a grinding mill lining. Channel element comprises a channel-shaped housing or body 94 into which a rubber or polymeric filler material 96 has been molded. As indicated in FIG. 17, filler material 96 may contain variously shaped particles 98 of a wear resistant material.

A rubber or polymeric filler material as described herein preferably has the following properties: a Shore A hardness of 60 or 65, a tensile strength of 3200 psi, an elongation potential or stretchability of 500%, a tear strength of 450 PPLI, a maximum service temperature of 190° F., and a specific gravity of 1.14. In addition, the rubber or polymeric material should have a good resistance to dilute acid and a fair resistance to concentrated acid, an excellent resistance to moisture, a good resistance to salt solutions, and a good resistance to oxygenated solvents. The resistance to hydrocarbon solvents, oil and gasoline, and some animal and vegetable oils will be poor. Atmospheric aging of the filler material should be fair and low temperature flexibility excellent. The material should have a good compression set and a fair permeability.

Figure 18:
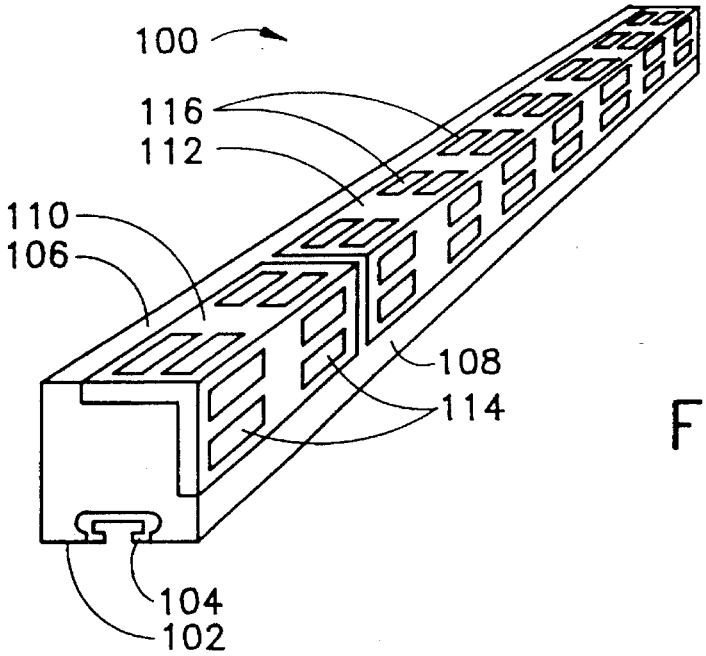
FIG. 18 is an isometric view of a grinding mill lifter bar in accordance with the present invention.

As depicted in FIG. 18, a standard size lifter bar comprises an elongate prismatic body 100 made of a rubber or polymeric material and having a bottom face 102 in which a metal mounting insert 104 is embedded. In a top face 106 and a leading face 108 of body 100 are embedded one or more angled metal grid members 110 and 112 each defining a plurality of recesses 114 and 116. Grid members 110 and 112 are recessed into top face 106 and leading face 108 of body 100.

The standard size lifter bar of FIG. 18 may be used in ball mills, rod mills, etc.

Figure 19:
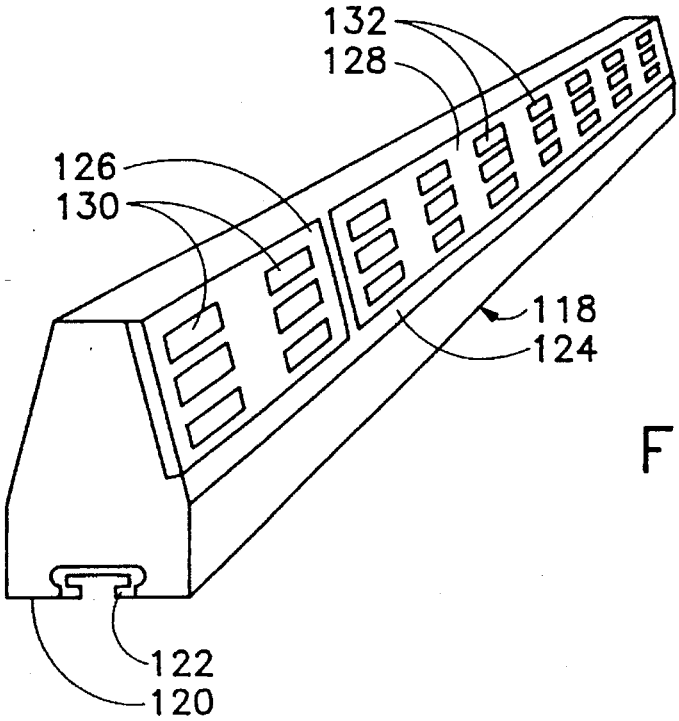
FIG. 19 is an isometric view of another grinding mill lifter bar in accordance with the present invention.

FIG. 19 shows a large size lifter bar for use in autogenous or semi-autogenous mills, with a wedge shaped body portion 118 of a rubber or polymeric material. In a bottom face 120 of body portion 118 is embedded a metal mounting insert 122, while in an inclined leading face 124 one or more metal grid members 126 and 128 are embedded. Metal grid members 126 and 128 have openings or recesses 130 and 132 in which the rubber or polymeric material of body portion 118 is molded.

Reinforced lifter bars as illustrated in FIGS. 18 and 19 are useful in grinding mills where the rubber mill liner wears out too quickly and the economy is not satisfactory. Preferably, the grid members 110, 112, 124 are made of a hard metal such as manganese to give the lifter bars a longer wear life.

Rubber is molded in the openings or recesses 114, 116, 126 of grid members 110, 112, 124. This rubber wears faster than the metal, creating a dish shape or eddy in the grid openings. Such dishes or eddies grip some of the grinding media or ore as it passes through the charge. Thus, the grinding media impacts and wears upon itself which also helps to prolong the life of the lifter bar.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proferred by way of example to facilitate comprehension of the invention and should not be construed to limit the scope thereof.

What is claimed is:

1. A grinding mill assembly comprising a cylindrical housing having a longitudinally extending axis and a lining inside said housing, said housing having a direction of rotation about said axis, said lining including at least one elongate lifter bar extending parallel to said axis along an inner surface of said housing, said lifter bar including an elongate body made of a rubber or polymeric material and having a leading face facing in said direction of rotation, a metal section being embedded in said body at said face, said metal section defining at said leading face a plurality of recesses filled with the rubber or polymeric material of said body.

2. The grinding mill assembly defined in claim 1 wherein said body is wedge-shaped.

3. The grinding mill assembly defined in claim 1 wherein said metal grid section is planar.

4. The grinding mill assembly defined in claim 1 wherein said body has a top face facing radially inwardly towards said axis, said metal section being in the form of an angle profile having two surfaces oriented at a substantial angle relative to one another, said metal section being embedded in said body also at said top face.

5. The grinding mill assembly defined in claim 1 wherein said metal section is in the form of a grid.

* * * * *